US007859468B2

(12) United States Patent
Ali et al.

(10) Patent No.: US 7,859,468 B2
(45) Date of Patent: Dec. 28, 2010

(54) MOBILE WIRELESS COMMUNICATIONS DEVICE INCLUDING A FOLDED MONOPOLE MULTI-BAND ANTENNA AND RELATED METHODS

(75) Inventors: Shirook Ali, Mississauga (CA); Geyi Wen, Waterloo (CA)

(73) Assignee: Research In Motion Limited, Ontario (CA)

( * ) Notice: Subject to any disclaimer, the term of this patent is extended or adjusted under 35 U.S.C. 154(b) by 582 days.

(21) Appl. No.: 11/847,477

(22) Filed: Aug. 30, 2007

(65) Prior Publication Data

US 2009/0058734 A1 Mar. 5, 2009

(51) Int. Cl.
*H01Q 1/24* (2006.01)
*H01Q 1/38* (2006.01)

(52) U.S. Cl. ..... 343/702; 343/828

(58) Field of Classification Search ..... 343/700 MS, 343/702, 803, 804, 846
See application file for complete search history.

(56) References Cited

U.S. PATENT DOCUMENTS

| | | | | |
|---|---|---|---|---|
| 5,757,333 | A | 5/1998 | Kitchener | 343/246 |
| 6,054,955 | A | 4/2000 | Schlegel, Jr. et al. | 343/702 |
| 6,683,571 | B2 * | 1/2004 | Ghosh et al. | 343/700 MS |
| 7,023,387 | B2 | 4/2006 | Wen et al. | 343/700 MS |
| 7,084,831 | B2 * | 8/2006 | Takagi et al. | 343/860 |
| 7,504,997 | B2 | 3/2009 | Baliarda et al. | |
| 7,629,933 | B2 * | 12/2009 | Wen et al. | 343/702 |
| 2003/0001781 | A1 | 1/2003 | Konishi | |
| 2004/0008141 | A1 | 1/2004 | Sato et al. | |
| 2005/0057410 | A1 | 3/2005 | Chiang et al. | 343/739 |
| 2006/0001592 | A1 | 1/2006 | Chang | 343/895 |
| 2006/0017635 | A1 | 1/2006 | Zheng | 343/748 |
| 2006/0109183 | A1 | 5/2006 | Rosenberg et al. | 343/702 |
| 2006/0152415 | A1 | 7/2006 | Huang et al. | 343/700 |

FOREIGN PATENT DOCUMENTS

| | | |
|---|---|---|
| EP | 0863571 | 9/1998 |
| JP | 08288731 | 11/1996 |
| JP | 2003289214 | 10/2003 |
| JP | 2004056580 | 2/2004 |
| JP | 2005080229 | 3/2005 |

* cited by examiner

*Primary Examiner*—Michael C Wimer

(57) ABSTRACT

A mobile wireless communications device may include a portable housing, a printed circuit board (PCB) carried within the portable housing, and wireless communications circuitry carried by the PCB within the portable housing. The device may also include a folded monopole antenna assembly coupled to the wireless communications circuitry. The folded monopole antenna assembly may include a dielectric body adjacent the PCB and having a generally rectangular shape defining opposing top and bottom faces, opposing first and second end faces, and opposing first and second side faces. The antenna may also include a conductive trace coupled to the wireless communications circuitry and having a first end section extending along the first end face, a second end section extending along the second end face, and an intermediate section extending along the top, bottom, first side and second side faces.

21 Claims, 7 Drawing Sheets

MOBILE WIRELESS COMMUNICATIONS DEVICE INCLUDING A FOLDED MONOPOLE MULTI-BAND ANTENNA AND RELATED METHODS

FIELD OF THE INVENTION

The present invention relates to the field of communications systems, and, more particularly, to mobile wireless communications devices and antennas therefor, and related methods.

BACKGROUND OF THE INVENTION

One challenge in the development of antennas for mobile handheld devices, such as cellular devices, is the balance between the antenna size and its performance. On one hand, users have come to expect smaller and relatively stylish devices with no visible antenna structure, which imposes restrictions on the device form factor and thus the available antenna size. On the other hand, users expect devices with an antenna that efficiently supports the various wireless communications standards. Yet, this requires that the antenna has a reasonable size to achieve requisite performance often over multiple operating frequency bands. See, e.g., Geyi, "Physical Limitations of Antenna," IEEE Transactions on Antennas and Propagation, vol. AP-51, pages 2116-2123, 2003.

Planar inverted-F antennas (PIFAs) are commonly used for handheld devices. However, PIFAs typically have relatively narrow bandwidths. To overcome this shortcoming, various techniques are sometimes used to increase the effective bandwidth of PIFAs, such as using parasitic elements, additional shorting pins, etc. Yet, such structures can unduly complicate the antenna structure and increase its cost. See, e.g., U.S. Pat. No. 7,023,387; Liu et al., "Dual-Frequency Planar Inverted-F Antenna," IEEE Transactions on Antennas and Propagation, vol. 45, no. 9, pages 1451-1457, October 1997; Rowell et al., "A Compact PIFA Suitable for Dual-Frequency 900/1800-Mhz Operation," IEEE Transactions on Antennas and Propagation, vol. 46, pages 586598, April 1998; Guo et al., "Miniature Built-In Quad-Band Antennas for Mobile Handsets," IEEE Antennas Wireless Propagation. Letters, vol. 2, pages 30-32, 2003.

Another form of antenna, i.e., the monopole antenna, typically has a relatively wider bandwidth as compared with that of a PIFA. However, a significant drawback of such monopole antennas is that they typically require more surface area (i.e., they are larger) than a comparable PIFA. Another drawback of monopole antennas is that, due in part to the size constraints, they are typically implemented as external antennas, whereas a PIFA is easier to implement as an internal antenna.

Even so, another advantage that a 2D monopole antenna has over the PIFA, in addition to its wideband response, it has a low profile, is simpler to design, and less expensive to fabricate.

One exemplary monopole antenna arrangement is set forth in U.S. Pat. No. 6,054,955 to Schlegel, Jr., et al. The antenna arrangement is for use in the housing of a portable communications device, such as a laptop. The antenna arrangement includes a pair of spaced folded monopole antennas in 2D. Each antenna includes a first printed circuit board having a conducting surface that forms a ground plane. Mounted on the first circuit board is a second printed circuit board having a right-angled strip of conducting material, which forms a folded monopole radiating element. The folding of the monopole reduces its height, to thereby enable it to fit into small casings and the like. To compensate for the effects of the folded monopole on the electrical match, frequency bandwidth and electromagnetic fields, a shunt inductance is introduced between the monopole and the ground plane. The antennas are mounted within cavities that can be lined or coated with metallic material, to improve the radiation patterns of the antennas and isolate them from the electronic components of the communications system.

Despite the existence of such antenna arrangements, further advancements in monopole antenna structures for mobile wireless communications devices may be desirable in some applications.

DETAILED DESCRIPTION OF THE PREFERRED EMBODIMENTS

Figure 1:
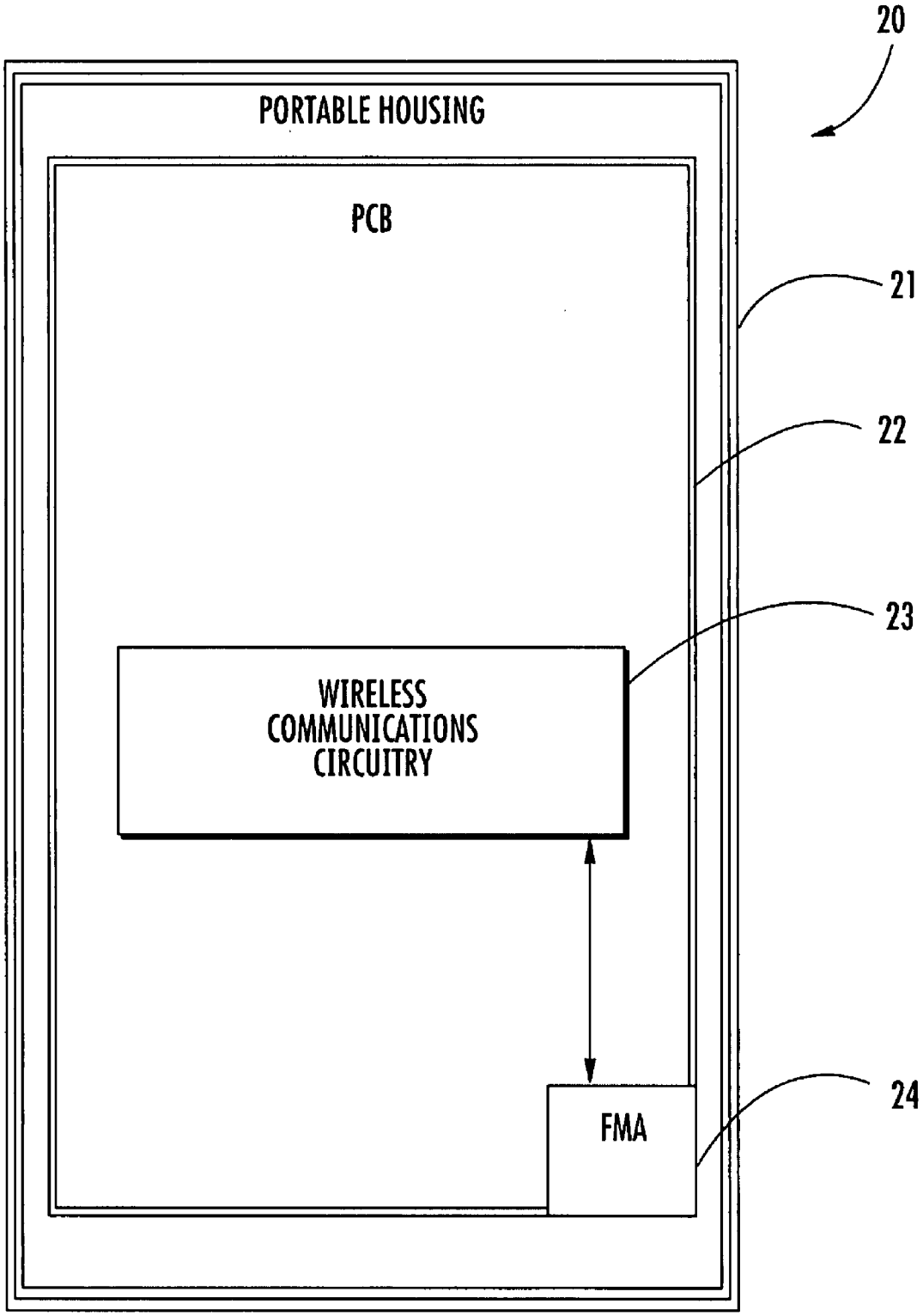
FIG. 1 is a schematic block diagram of a mobile wireless communications device in accordance with an exemplary embodiment including a folded monopole antenna (FMA).
Figure 2:
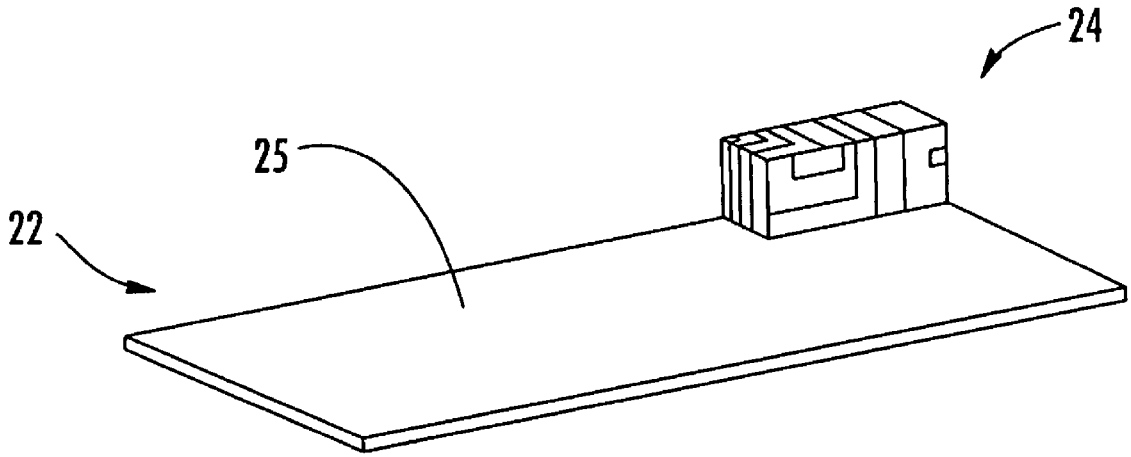
FIG. 2 is a top perspective view of a printed circuit board (PCB) with a folded monopole antenna thereon in accordance with one aspect.
Figure 3:
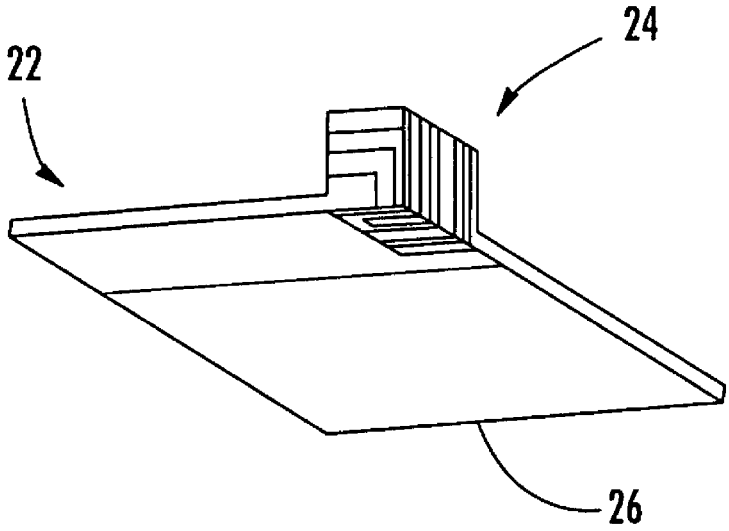
FIG. 3 is a bottom perspective view of the PCB and folded monopole antenna of FIG. 2.
Figure 4:
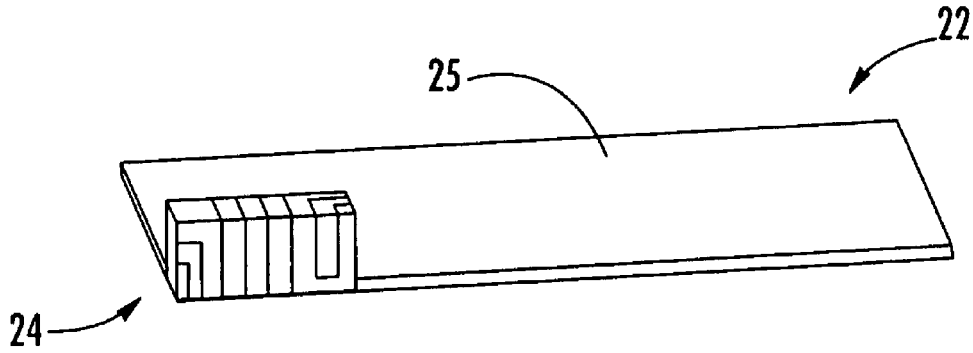
FIG. 4 is a rotated top perspective view of the PCB and folded monopole antenna of FIG. 2.

The present description is made with reference to the accompanying drawings, in which preferred embodiments are shown. However, many different embodiments may be used, and thus the description should not be construed as limited to the embodiments set forth herein. Rather, these embodiments are provided so that this disclosure will be thorough and complete. Like numbers refer to like elements throughout.

Generally speaking, a mobile wireless communications device is disclosed herein which may include a portable housing, a printed circuit board (PCB) carried within the portable housing, and wireless communications circuitry carried by the PCB within the portable housing. Furthermore, the device may also include a folded monopole antenna assembly. More particularly, the folded monopole antenna assembly may include a dielectric body adjacent the PCB and having a generally rectangular shape defining opposing top and bottom faces, opposing first and second end faces, and opposing first and second side faces. The antenna assembly may also include a conductive trace coupled to the wireless communications circuitry having a first end section extending along the first end face, a second end section extending along the second end face, and an intermediate section extending along the top, bottom, first side and second side faces.

In addition, the conductive trace may further include at least one conductive impedance matching patch coupled to the intermediate section. In some embodiments, the at least one conductive impedance matching patch may comprise a plurality of spaced-apart impedance matching patches. The at least one conductive impedance matching patch may extend along one or more of the top face, the first and second end faces, and the first and second side faces.

The first end section may define a feed point for the conductive trace. Furthermore, the first and second side faces may have greater widths than the first and second end faces. By way of example, the wireless communications circuitry may comprise a cellular transceiver. Also, the conductive trace may operate over a plurality of radio frequency (RF) communications bands.

A folded monopole antenna assembly for a mobile wireless communications device and method for making the same are also provided. The method may include forming a dielectric body having a generally rectangular shape defining opposing top and bottom faces, opposing first and second end faces, and opposing first and second side faces. The method may further include forming a conductive trace on the dielectric body having a first end section extending along the first end face, a second end section extending along the second end face, and an intermediate section extending along the top, bottom, first side and second side faces.

Referring initially to FIGS. 1-6B, a mobile wireless communications device 20 illustratively includes a portable housing 21, a printed circuit board (PCB) 22 carried within the portable housing, and wireless communications circuitry 23 carried by the PCB within the portable housing. The wireless communications circuitry 23 is carried on a top dielectric layer 25 of the PCB 22 (FIG. 2), and the PCB also has a ground plane 26 on a bottom side thereof (FIG. 3) opposite the top dielectric layer. By way of example, the wireless communications circuitry 23 may comprise cellular communications circuitry, e.g., a cellular transceiver. Other wireless communications circuitry, such as wireless local area network (WLAN) and satellite positioning (e.g., GPS) communications circuitry, may also be used, as will be discussed further below.

The device 20 further illustratively includes a folded monopole antenna assembly 24. In particular, the folded monopole antenna assembly 24 illustratively includes a dielectric body or frame 30 adjacent the PCB 22 and having a generally rectangular shape defining opposing top and bottom faces 35 and 36, opposing first and second end faces 37 and 38, and opposing first and second side faces 39 and 40 (see FIGS. 6A and 6B). It should be noted that although the edges of the body 30 are shown as being 90° (i.e., squared off), these edges/corners may be rounded, etc., in some embodiments.

Figure 5:
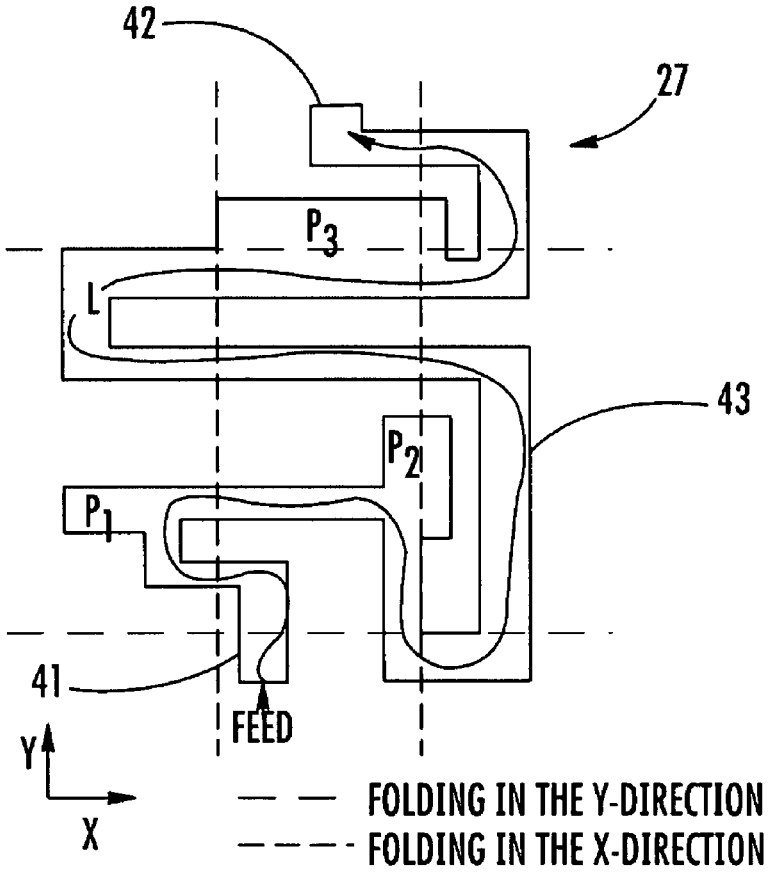
FIG. 5 is a 2D plan view (i.e., unfolded) of the conductive trace of the folded monopole antenna of FIG. 2.
Figure 6A:
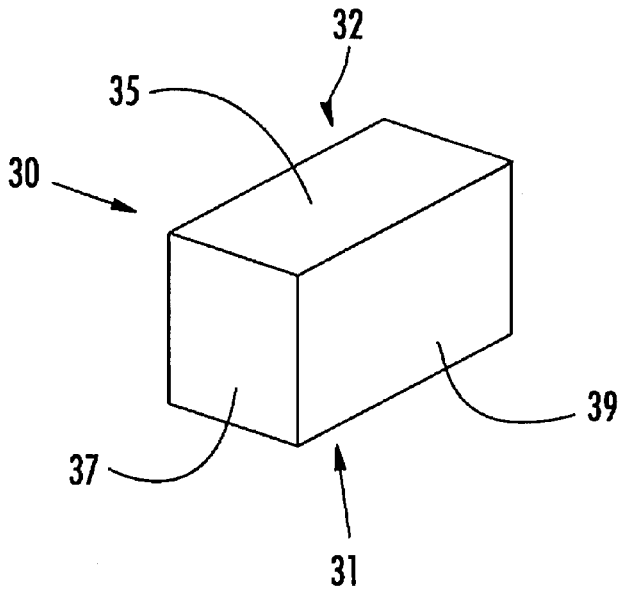
FIGS. 6A and 6B are enlarged perspective views of the dielectric body of the folded monopole antenna as seen in FIGS. 2 and 3, respectively, with the conductive trace removed.
Figure 6B:
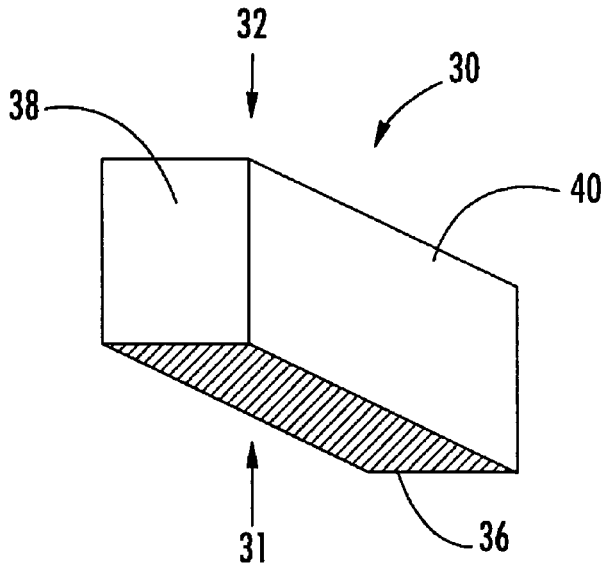

The antenna assembly 24 also illustratively includes a conductive trace coupled to the wireless communications circuitry 23 having a first end section 41 extending along the first end face 37, a second end section 42 extending along the second end face 38, and an intermediate section 43 extending along the top, bottom, first side and second side faces 35, 36, 39 and 40. The conductive trace defines a folded monopole antenna element, the unfolded two-dimensional (2D) structure of which is shown in FIG. 5.

In the illustrated example, the conductive trace further includes three conductive impedance matching patches $P_1$, $P_2$, and $P_3$ spaced-apart along the conductive trace and coupled to the intermediate section 43, as shown. It should be noted that in other embodiments, however, different numbers, shapes, and/or placements of impedance matching patches may be used, or none at all. In the present example, the patch $P_1$ is on the second side face 40, the second patch $P_2$ is on the top face 35 and the first side face 39, and the third patch $P_3$ is on the first side face 39 and the second end face 38. The patches $P_1$, $P_2$, and $P_3$ advantageously improve matching for the low and high frequency bands, as will be appreciated by those skilled in the art.

In one embodiment, the wireless communications circuitry 23 includes cellular transmitter/receiver circuitry for communicating over a plurality of cellular communications bands. By way of example, such cellular bands may include Global System for Mobile communication (GSM), International Mobile Telecommunications-2000 (IMT), Universal Mobile Telecommunications System (UMTS), Digital Communication Services (DCS), and/or Personal Communication Services (PCS) bands. However, other types of wireless radio frequency (RF) communications circuitry (e.g., Bluetooth/802.11 WLAN circuitry), may also be electrically coupled to the folded monopole antenna assembly 24 in different embodiments, as well as satellite positioning receiver circuitry (e.g., GPS, Galileo, GLONASS, etc.).

Figure 7:
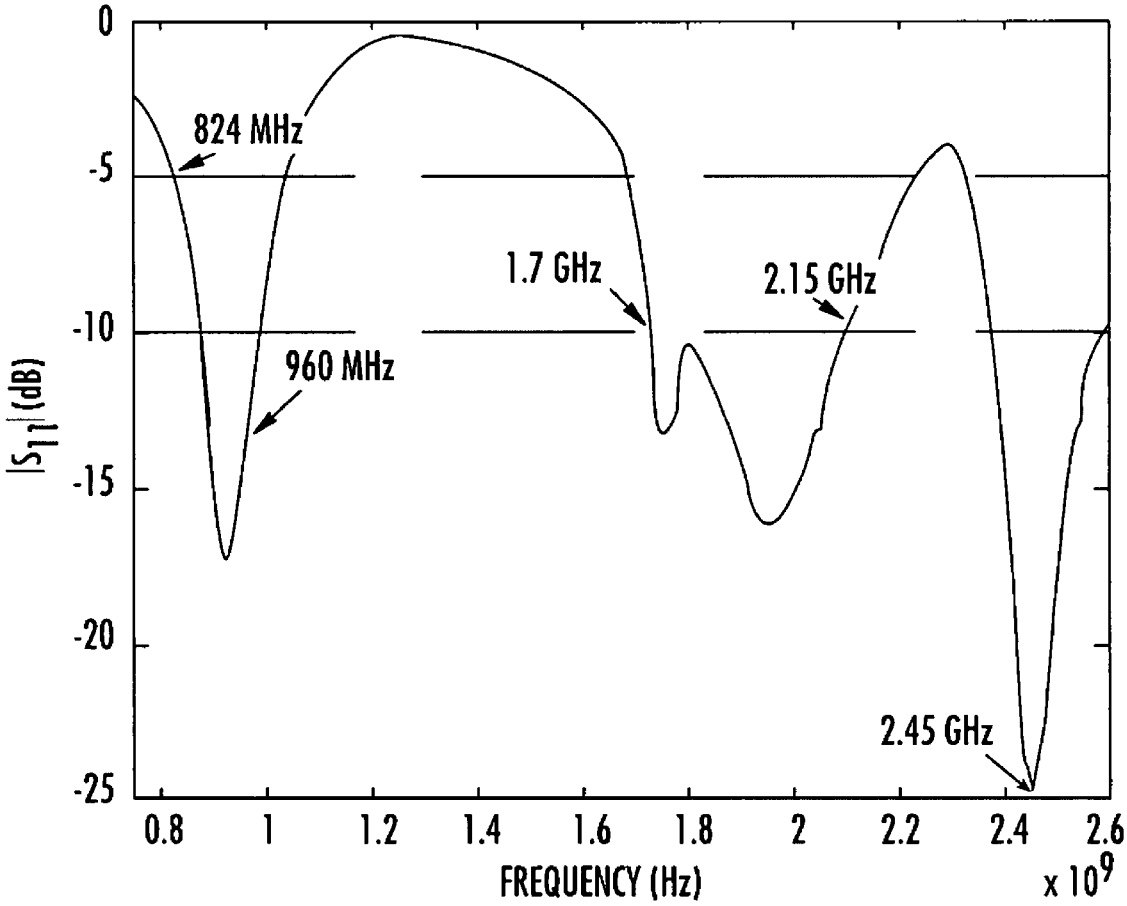
FIG. 7 is a graph of return loss vs. frequency for an embodiment of the antenna of FIG. 2.
Figure 8:
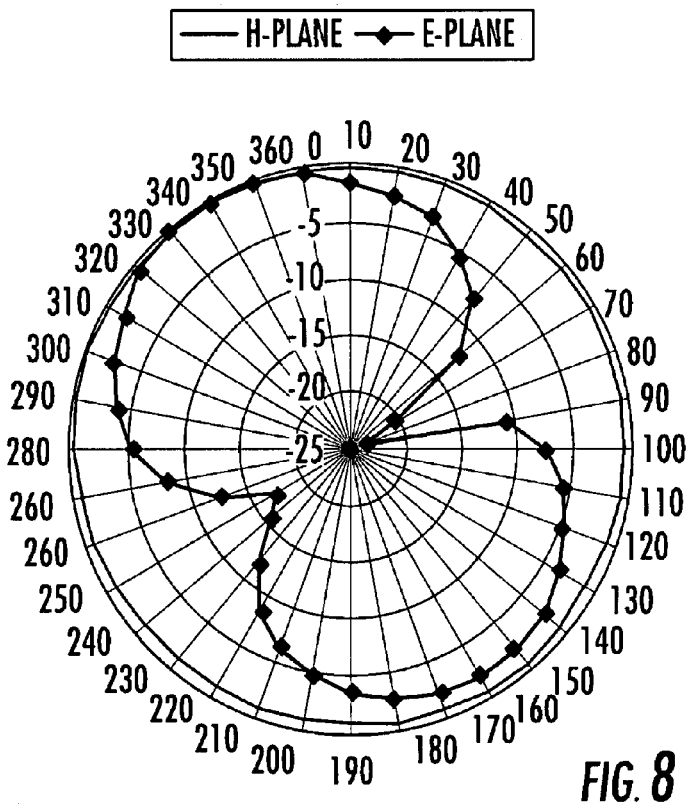
FIG. 8 is a measured radiation pattern diagram for an embodiment of the antenna of FIG. 2 at 919 MHz.
Figure 9:
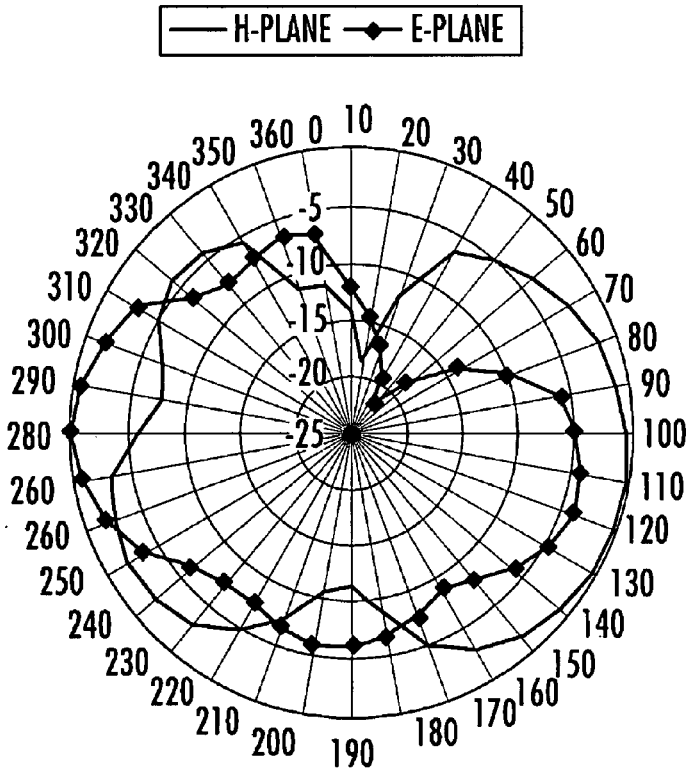
FIG. 9 is a measured radiation pattern diagram for an embodiment of the antenna of FIG. 2 at 1.97 GHz.

The folded monopole antenna assembly 24 advantageously provides the multi-band and compact characteristics of a PIFA, as well as the broadband, environmental isolation, and simplicity characteristics of a monopole antenna. In one exemplary embodiment, the antenna 24 supports at least six frequency bands (i.e., hex-band), although other numbers of bands may be supported in different embodiments. More particularly, in this exemplary embodiment the antenna assembly 24 supports GSM 800/900/1800/1900, IMT-2000, UMTS 2200, DCS/PCS 1800/1900, Bluetooth 2400, and WLAN 2450, as shown in the measured return loss vs. frequency graph of FIG. 7. The measured radiation pattern for the exemplary hex-band antenna 24 at operating frequencies of 919 MHz and 1.97 GHz are shown in FIGS. 8 and 9, respectively.

In the exemplary embodiment, a length L of the conductive trace 27 is a quarter wavelength at about 800 MHz, although different length-to-wavelength ratios are also possible in different embodiments. The length L controls the fundamental resonating mode of the antenna 24, as will be appreciated by those skilled in the art. The modes at higher frequencies are generated at various portions of this length. The 3D wrapping of the antenna around the dielectric body 30 controls the current distribution along the monopole length L, and thus controls the electrical length(s) for the higher resonant frequency band(s) as well as antenna bandwidth, as will also be appreciated by those skilled in the art.

In the exemplary implementation, the antenna assembly 24 has dimensions of 10 mm×20 mm×8.5 mm, the ground plane 26 has dimensions of 55 mm×87 mm, and a 1.5 mm thick FR-4 dielectric ground plane 25 with relative permittivity 4.4 may support the antenna and the ground plane. However, it will be appreciated by those skilled in the art that other dimensions and/or materials may be used in different embodiments.

The antenna assembly 24 therefore advantageously provides broadband operation in the supported frequency bands. The relatively small size of the antenna assembly 24 results from "wrapping" the conductive trace 43 into the above-described 3D structure, which provides a relatively compact structure in addition to a relatively simplicity due to the fact that it is a monopole antenna. Moreover, the antenna assembly 24 advantageously provides desired matching properties at the supported frequency bands without the need for additional matching circuitry, although such circuitry may be used in some embodiments if desired, as will be appreciated by those skilled in the art. The 3D shape of the antenna assembly 24 not only significantly reduces the antenna size, but it may also provide radiation pattern diversity as well.

A method for making the folded monopole antenna 24 may include forming the dielectric body 30 having a generally rectangular shape defining opposing top and bottom faces 35 and 36, opposing first and second end faces 37 and 38, and opposing first and second side faces 39 and 40. The method may further include forming a conductive trace 27 on the dielectric body 30 having a first end section 41 extending along the first end face 37, a second end section 42 extending along the second end face 38, and an intermediate section extending along the top, bottom, first side and second side faces 35, 36, 39, and 40. It should be noted that in some embodiments the conductive trace 27 may be etched on a supporting dielectric surface, as will be appreciated by those skilled in the art.

Exemplary components of a hand-held mobile wireless communications device 1000 in which the antenna 24 may be used are further described below with reference to FIG. 10. The device 1000 illustratively includes a housing 1200, a keypad 1400 and an output device 1600. The output device shown is a display 1600, which is preferably a full graphic LCD. Other types of output devices may alternatively be utilized. A processing device 1800 is contained within the housing 1200 and is coupled between the keypad 1400 and the display 1600. The processing device 1800 controls the operation of the display 1600, as well as the overall operation of the mobile device 1000, in response to actuation of keys on the keypad 1400 by the user.

The housing 1200 may be elongated vertically, or may take on other sizes and shapes (including clamshell housing structures). The keypad may include a mode selection key, or other hardware or software for switching between text entry and telephony entry.

Figure 10:
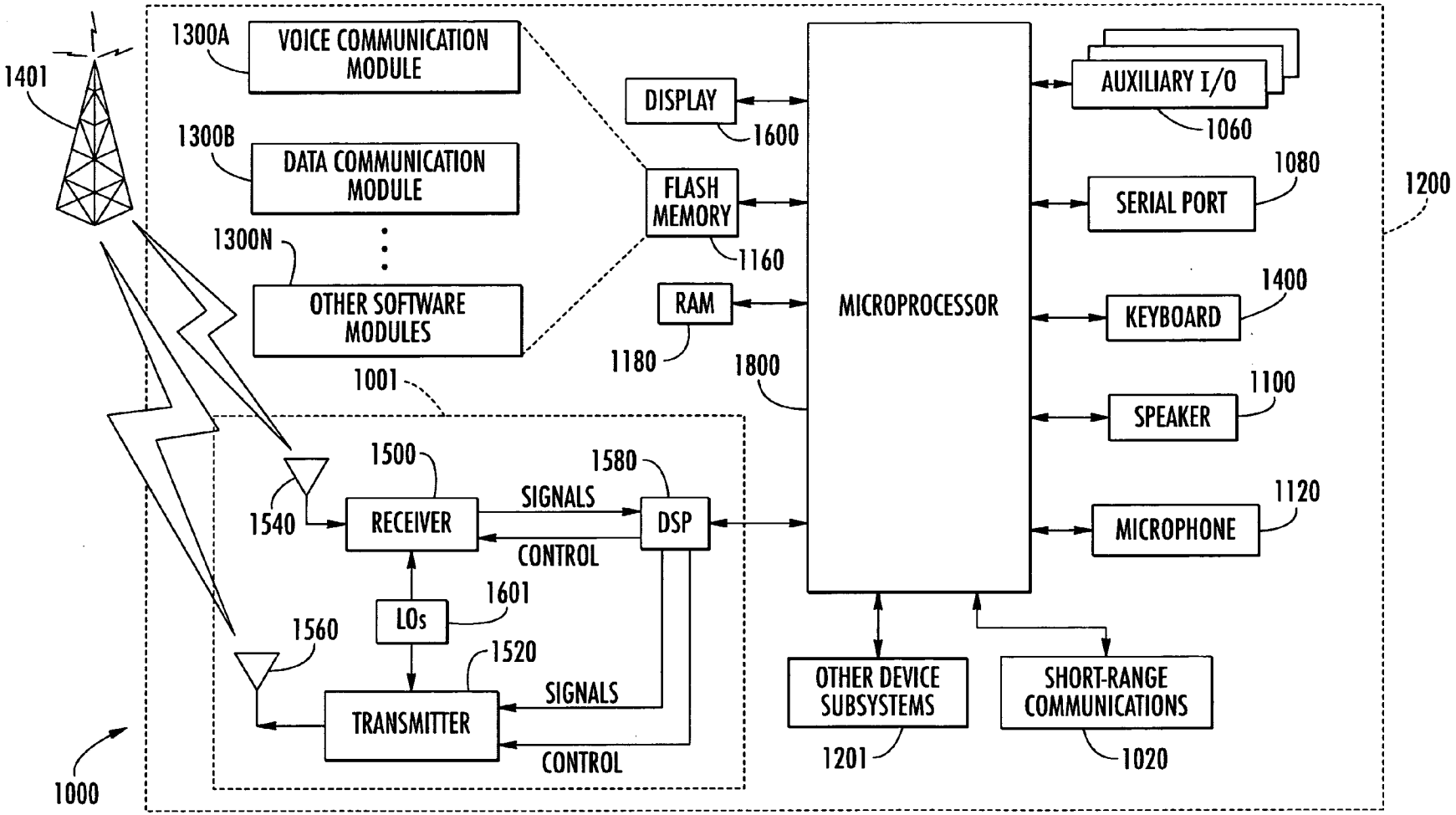
FIG. 10 is a schematic block diagram illustrating exemplary components of a mobile wireless communications device in which the folded monopole antenna of FIG. 2 may be used.

In addition to the processing device 1800, other parts of the mobile device 1000 are shown schematically in FIG. 10. These include a communications subsystem 1001; a short-range communications subsystem 1020; the keypad 1400 and the display 1600, along with other input/output devices 1060, 1080, 1100 and 1120; as well as memory devices 1160, 1180 and various other device subsystems 1201. The mobile device 1000 is preferably a two-way RF communications device having voice and data communications capabilities. In addition, the mobile device 1000 preferably has the capability to communicate with other computer systems via the Internet.

Operating system software executed by the processing device 1800 is preferably stored in a persistent store, such as the flash memory 1160, but may be stored in other types of memory devices, such as a read only memory (ROM) or similar storage element. In addition, system software, specific device applications, or parts thereof, may be temporarily loaded into a volatile store, such as the random access memory (RAM) 1180. Communications signals received by the mobile device may also be stored in the RAM 1180.

The processing device 1800, in addition to its operating system functions, enables execution of software applications 1300A-1300N on the device 1000. A predetermined set of applications that control basic device operations, such as data and voice communications 1300A and 1300B, may be installed on the device 1000 during manufacture. In addition, a personal information manager (PIM) application may be installed during manufacture. The PIM is preferably capable of organizing and managing data items, such as e-mail, calendar events, voice mails, appointments, and task items. The PIM application is also preferably capable of sending and receiving data items via a wireless network 1401. Preferably, the PIM data items are seamlessly integrated, synchronized and updated via the wireless network 1401 with the device user's corresponding data items stored or associated with a host computer system.

Communication functions, including data and voice communications, are performed through the communications subsystem 1001, and possibly through the short-range communications subsystem. The communications subsystem 1001 includes a receiver 1500, a transmitter 1520, and one or more antennas 1540 and 1560. In addition, the communications subsystem 1001 also includes a processing module, such as a digital signal processor (DSP) 1580, and local oscillators (LOs) 1601. The specific design and implementation of the communications subsystem 1001 is dependent upon the communications network in which the mobile device 1000 is intended to operate. For example, a mobile device 1000 may include a communications subsystem 1001 designed to operate with the Mobitex™, Data TAC™ or General Packet Radio Service (GPRS) mobile data communications networks, and also designed to operate with any of a variety of voice communications networks, such as AMPS, TDMA, CDMA, WCDMA, PCS, GSM, EDGE, etc. Other types of data and voice networks, both separate and integrated, may also be utilized with the mobile device 1000. The mobile device 1000 may also be compliant with other communications standards such as 3GSM, 3GPP, UMTS, etc.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore requires a subscriber identity module, commonly referred to as a SIM card, in order to operate on a GPRS network.

When required network registration or activation procedures have been completed, the mobile device 1000 may send and receive communications signals over the communication network 1401. Signals received from the communications network 1401 by the antenna 1540 are routed to the receiver 1500, which provides for signal amplification, frequency down conversion, filtering, channel selection, etc., and may also provide analog to digital conversion. Analog-to-digital conversion of the received signal allows the DSP 1580 to perform more complex communications functions, such as demodulation and decoding. In a similar manner, signals to be transmitted to the network 1401 are processed (e.g. modulated and encoded) by the DSP 1580 and are then provided to the transmitter 1520 for digital to analog conversion, frequency up conversion, filtering, amplification and transmission to the communication network 1401 (or networks) via the antenna 1560.

In addition to processing communications signals, the DSP 1580 provides for control of the receiver 1500 and the transmitter 1520. For example, gains applied to communications signals in the receiver 1500 and transmitter 1520 may be adaptively controlled through automatic gain control algorithms implemented in the DSP 1580.

In a data communications mode, a received signal, such as a text message or web page download, is processed by the communications subsystem 1001 and is input to the processing device 1800. The received signal is then further processed by the processing device 1800 for an output to the display 1600, or alternatively to some other auxiliary I/O device 1060. A device user may also compose data items, such as e-mail messages, using the keypad 1400 and/or some other auxiliary I/O device 1060, such as a touchpad, a rocker switch, a thumb-wheel, or some other type of input device. The composed data items may then be transmitted over the communications network 1401 via the communications subsystem 1001.

In a voice communications mode, overall operation of the device is substantially similar to the data communications mode, except that received signals are output to a speaker 1100, and signals for transmission are generated by a microphone 1120. Alternative voice or audio I/O subsystems, such as a voice message recording subsystem, may also be implemented on the device 1000. In addition, the display 1600 may also be utilized in voice communications mode, for example to display the identity of a calling party, the duration of a voice call, or other voice call related information.

The short-range communications subsystem enables communication between the mobile device 1000 and other proximate systems or devices, which need not necessarily be similar devices. For example, the short-range communications subsystem may include an infrared device and associated circuits and components, or a Bluetooth™ communications module to provide for communication with similarly-enabled systems and devices.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims.

That which is claimed is:

1. A mobile wireless communications device comprising:

a portable housing;

a printed circuit board (PCB) carried within said portable housing;

wireless communications circuitry carried by said PCB within said portable housing; and a folded monopole antenna assembly comprising a dielectric body adjacent said PCB and having a generally rectangular shape defining opposing top and bottom faces, opposing first and second end faces, and opposing first and second side faces, and a conductive trace coupled to said wireless communications circuitry and having a first end section extending along the first end face, a second end section extending along the second end face, and an intermediate section extending along the top, bottom, first side and second side faces, wherein said conductive trace further comprises at least one conductive impedance matching patch coupled to said intermediate section.

2. The mobile wireless communications device of claim 1 wherein said at least one conductive impedance matching patch comprises a plurality of spaced-apart impedance matching patches.

3. The mobile wireless communications device of claim 1 wherein said at least one conductive impedance matching patch extends along the top face.

4. The mobile wireless communications device of claim 1 wherein said at least one conductive impedance matching patch extends along at least one of the first and second end faces.

5. The mobile wireless communications device of claim 1 wherein said at least one conductive impedance matching patch extends along at least one of the first and second side faces.

6. The mobile wireless communications device of claim 1 wherein said first end section defines a feed point for said conductive trace.

7. The mobile wireless communications device of claim 1 wherein said first and second side faces have greater widths than said first and second end faces.

8. The mobile wireless communications device of claim 1 wherein said wireless communications circuitry comprises a cellular transceiver.

9. The mobile wireless communications device of claim 1 wherein said folded monopole antenna operates over a plurality of radio frequency (RF) communications bands.

10. A mobile wireless communications device comprising:

a portable housing;

a printed circuit board (PCB) carried within said portable housing;

wireless communications circuitry carried by said PCB within said portable housing; and a folded monopole antenna assembly, comprising a dielectric body adjacent said PCB and having a generally rectangular shape defining opposing top and bottom faces, opposing first and second end faces, and opposing first and second side faces, and a conductive trace coupled to said wireless communications circuitry and operable over a plurality of radio frequency (RF) communications bands, said conductive trace having a first end section extending along the first end face, a second end section extending along the second end face, and an intermediate section extending along the top, bottom, first side and second side faces, said conductive trace further comprising at least one conductive impedance matching patch coupled to said intermediate section.

11. The mobile wireless communications device of claim 10 wherein said at least one conductive impedance matching patch comprises a plurality of spaced-apart impedance matching patches.

12. The mobile wireless communications device of claim 10 wherein said at least one conductive impedance matching patch extends along the top face.

13. The mobile wireless communications device of claim 10 wherein said at least one conductive impedance matching patch extends along at least one of the first and second end faces.

14. The mobile wireless communications device of claim 10 wherein said at least one conductive impedance matching patch extends along at least one of the first and second side faces.

15. A folded monopole antenna assembly for a mobile wireless communications device comprising a portable housing, a printed circuit board (PCB) carried within the portable housing, and wireless communications circuitry carried by the PCB within the portable housing, the folded monopole antenna comprising:

a dielectric body adjacent said PCB and having a generally rectangular shape defining opposing top and bottom faces, opposing first and second end faces, and opposing first and second side faces; and a conductive trace to be coupled to the wireless communications circuitry and having a first end section extending along the first end face, a second end section extending along the second end face, and an intermediate section extending along the top, bottom, first side and second side faces, wherein said conductive trace further comprises at least one conductive impedance matching patch coupled to said intermediate section.

16. The folded monopole antenna of claim 15 wherein said at least one conductive impedance matching patch comprises a plurality of spaced-apart impedance matching patches.

17. The folded monopole antenna of claim 15 wherein said at least one conductive impedance matching patch extends along the top face.

18. The folded monopole antenna of claim 15 wherein said at least one conductive impedance matching patch extends along at least one of the first and second end faces.

19. The folded monopole antenna of claim 15 wherein said at least one conductive impedance matching patch extends along at least one of the first and second side faces.

20. A method for making a folded monopole antenna assembly for a mobile wireless communications device comprising:

forming a dielectric body having a generally rectangular shape defining opposing top and bottom faces, opposing first and second end faces, and opposing first and second side faces; and forming a conductive trace on the dielectric body having a first end section extending along the first end face, a second end section extending along the second end face, and an intermediate section extending along the top, bottom, first side and second side faces, wherein forming the conductive trace further comprises forming at least one conductive impedance matching patch coupled to the intermediate section.

21. The method of claim 20 wherein forming the at least one conductive impedance matching patch comprises forming a plurality of spaced-apart impedance matching patches.

* * * * *